United States Patent [19]

Henderson

[11] 4,182,513

[45] Jan. 8, 1980

[54] BOW AND ARROW

[76] Inventor: Richard A. Henderson, 5041 Jade, Wichita, Kans. 67216

[21] Appl. No.: 869,676

[22] Filed: Jan. 16, 1978

[51] Int. Cl.[2] ..... F41B 5/02

[52] U.S. Cl. ..... 273/106.5 C; 124/24 R; 124/41 A

[58] Field of Search ..... 273/106.5 R, 106.5 C; 124/24 R, 41 A

[56] References Cited

U.S. PATENT DOCUMENTS

| | | | |
|---|---|---|---|
| 2,542,501 | 2/1951 | Fredrickson | 124/24 R X |
| 2,642,661 | 6/1953 | Fredrickson | 124/24 R X |
| 3,135,255 | 6/1964 | Hoyt | 124/24 R |
| 3,265,055 | 8/1966 | Gage | 124/24 R |
| 3,614,947 | 10/1971 | Feldman | 273/106.5 C X |

*Primary Examiner*—Paul E. Shapiro

*Attorney, Agent, or Firm*—Schmidt, Johnson, Hovey & Williams

[57] ABSTRACT

An arrow for use in combination with an archery bow, is provided with airfoil structure on its shaft in the form of a cambered wing section to increase the flight and accuracy of the arrow. A pair of fletches at the trailing end of the shaft are circumferentially spaced from one another 120° in order to provide desired flight stability for the arrow. An improved center shot bow is disclosed, having an oversized sight window and undersupporting arrow rest whereby to accommodate arrows with flight structure of a width greater than the diameter of the arrow shaft.

6 Claims, 10 Drawing Figures

BOW AND ARROW

This invention relates to archery equipment in general and particularly concerns an arrow of improved construction exhibiting longer flight and increased accuracy when used in combination with either a conventional or modified archery bow.

BACKGROUND

Arrows for use with archery bows are of course well known in the art and have been refined over the years to meet the special needs of the various types of archers such as hunters, target shooters and flight shooters. Modern day arrows typically comprise a tubular aluminum shaft (though wood and fiberglass are still in use), turkey feather fletching at the trailing end of the arrow, a steel or bronze point, and a plastic nock for engaging the bow string. All components of the modern arrow have been carefully engineered and reengineered for optimum performance.

Notwithstanding the relatively advanced technology of arrow design, present day arrows still have certain drawbacks when used in combination with conventional bows. One particular concern is the distance traveled or flight of an arrow when shot from a bow of standard construction . In this regard, at distances greater than about 25 yards, conventional arrows do not follow a level line of flight and hence, the archer must compensate for vertical drop of the arrow by aiming above his intended point of impact. Though sophisticated sighting equipment is available to aid the archer in judging the angle at which the arrow should be released in order to hit an intended target at a distance further than 25 yards, such devices are not totally accurate and they often require that the archer, particularly in the case of bow hunters, make a judgement as to target distance. Thus, the archer's accuracy at such long range target distance is significantly reduced.

SUMMARY OF THE INVENTION

The present invention offers an arrow which follows a level flight path at distances well beyond 25 yards by the provision of strategically positioned airfoil structure on the shaft of the arrow in combination with a flight-stabilizing arrangement of fletches at the trailing end of the arrow.

The airfoil structure includes a cambered wing section having its leading edge aligned with the normal flight direction of the arrow and mounted in spaced relation to the uppermost surface of the arrow shaft by a normally upright strut which extends between the shaft and the wing section. The wing section is mounted just forwardly of the center of gravity of the arrow thereby providing increased flight and greater accuracy.

In one form of the invention, adapted to be used with conventional bows, a pair of fletches radiating from the arrow shaft at the trailing edge of the latter are spaced angularly from one another approximately 120°, and the width of the wing section is less than the diameter of the arrow shaft. In a second form of the invention, the wing section is of a width greater than the diameter of the arrow shaft and there is provided three radially extending fletches arranged to present an inverted T in cross section. The second form of the invention is adapted to be used in combination with a modified center shot bow wherein the sight window is dimensioned to provide clearance for the wing section and fletching arrangement.

Figures 1, 2, 3, 4, 5, 6, 7, 8, 9, 10:
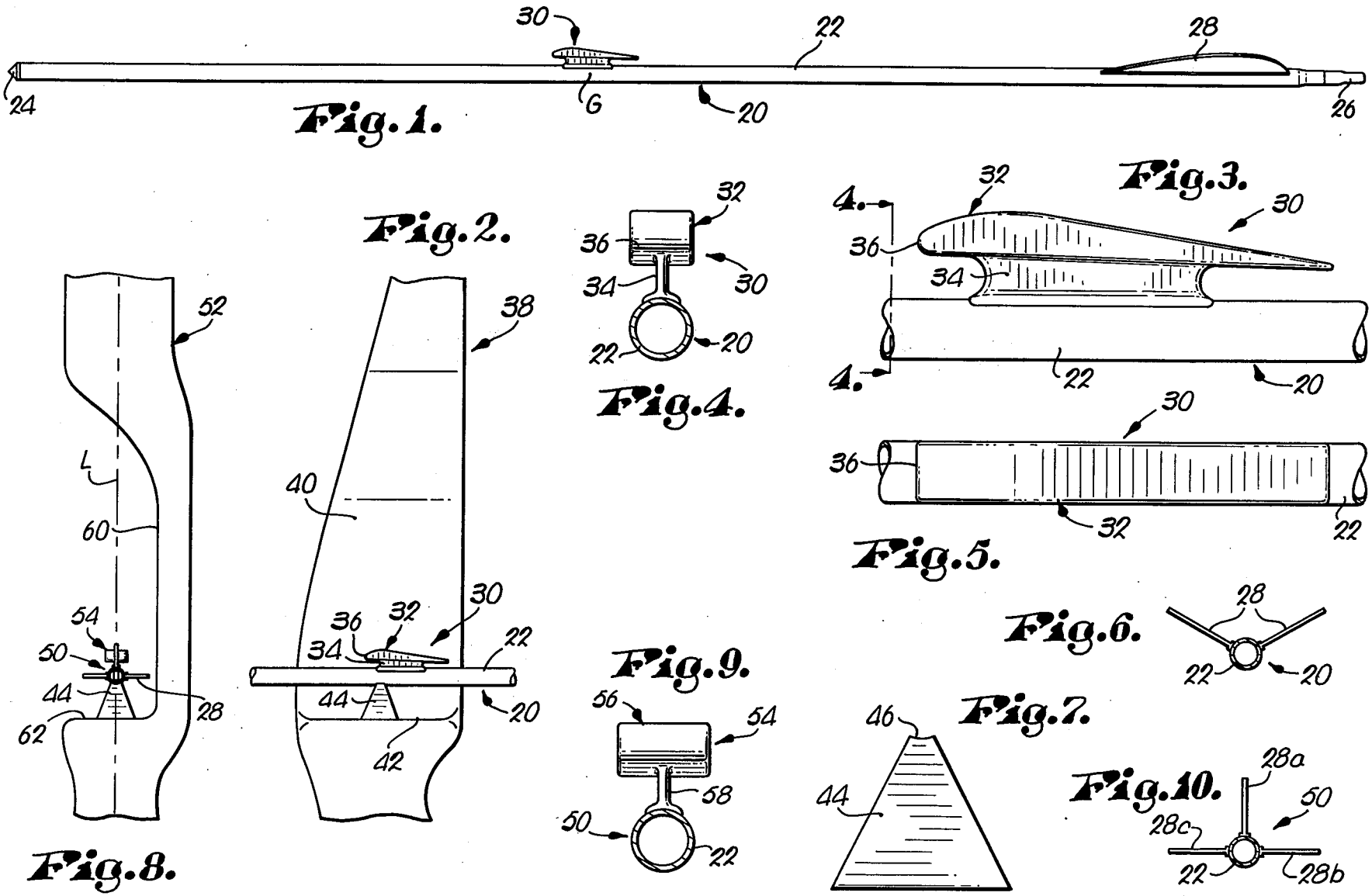
FIG. 1 is a side elevational view of an arrow constructed in accordance with the principles of the present invention.
FIG. 2 is a fragmentary, side elevational view of the arrow shown in combination with a conventional bow having an undersupporting arrow rest.
FIG. 3 is an enlarged, fragmentary, side elevational view showing details of construction of the airfoil structure.
FIG. 4 is a cross-sectional view taken along line 4—4 of FIG. 3.
FIG. 5 is an enlarged, fragmentary, top plan view showing the airfoil structure.
FIG. 6 is an enalarged, transverse section view of the arrow, showing the preferred arrangement of the fletches.
FIG. 7 is an enlarged, fragmentary, front elevational view showing the construction of the undersupporting arrow rest illustrated in FIG. 2.
FIG. 8 is an end view of a second embodiment of the arrow, shown in combination with a modified bow.
FIG. 9 is an enlarged, transverse cross-sectional view of the arrow in FIG. 8, taken just forwardly of the airfoil structure.
FIG. 10 is an enlarged, transverse cross-sectional view of the arrow illustrated in FIG. 8, taken just forwardly of the fletchings to illustrate the arrangement of the latter.

There is shown in FIGS. 1–6 an arrow 20 comprising an elongate, generally cylindrical, tubular aluminum shaft 22, a steel point 24 secured to the leading end of the shaft 22 and a high impact plastic nock 26 mounted on the trailing end of the shaft 22. There is also provided a pair of radially extending turkey feather fletches 28 attached to the circumferential surface of the shaft 22 adjacent the nock 26.

The combination of the shaft 22, point 24, nock 26, and fletches 28, has a center of gravity G disposed on the longitudinal axis of the shaft 22 intermediate the ends of the latter as shown for example in FIG. 1. Of course, the precise location of the center of gravity G is particularly determined by a number of factors such as the weight of the point 24 and nock 26.

As shown in FIG. 1, the arrow 20 is also provided with airfoil structure 30 mounted on the normally upwardly facing surface of shaft 22 in overlying relation to the center of gravity G. In preferred forms, the airfoil structure 30 is slightly offset forwardly of the center of gravity G in order to provide desired flight characteristics to the arrow 20.

Referring now to FIG. 3, the airfoil structure 30 comprises an aerodynamically configured, cambered wing section 32 supported in spaced relation to the shaft 22 by a generally upright strut 34 extending between the shaft 22 and the section 32. Wing section 32 is of a width substantially equal to the diameter of shaft 22 and is aligned with the normal flight path of the arrow 20 such that its leading edge 36 faces the direction of flight.

The fletches 28 are also mounted on the normally upwardly facing surface of shaft 22 and are angularly spaced from one another approximately 120°. It is to be understood that the fletches 28 could have an angular spacing anywhere within the range of 40° to 170° and still provide desired flight stability for the arrow 20.

In FIG. 2 there is illustrated a riser 38 of a conventional bow used in combination with the arrow 20. The sight window 40 of riser 38 has a lowermost shelf 42 on which is mounted an undersupporting arrow rest 44 adapted to engage the shaft 22 of arrow 20 in the manner shown. The rest 44 has a truncated pyramid shape with an uppermost arrow-receiving trough 46 adapted to be aligned with the normal direction of flight of the arrow 20.

The configuration of arrow 20 is such that it is compatible with a conventional center shot bow. In a second embodiment of the present invention, an arrow 50 shown in FIGS. 8–10 must be used in combination with a center shot bow having a modified riser 52 illustrated in FIG. 8. The arrow 50 is substantially the same in configuration as arrow 20 with the exception that there is provided larger airfoil structure 54 in place of the structure 30 and the arrangement of fletches 28 is as shown in FIG. 10 as opposed to the arrangement illustrated in FIG. 6.

The airfoil structure 54 comprises a wing section 56 supported on the upper portion of shaft 22 in spaced relation to the latter by an upright strut 58 similar to the manner in which the wing section 32 is supported by the strut 34. The positioning of the structure 54 along the length of shaft 22 and arrow 50 relative to the center of gravity G is substantially identical to the positioning of structure 30 and arrow 20. In contrast to wing section 32, however, wing section 56 has a width greater than the diameter of shaft 22 as best illustrated in FIG. 9.

The arrangement of the fletches 28 as shown in FIG. 10 defines an inverted T when viewed in cross section. A normally upright central fletch **28*a* disposed intermediate and spaced 90° from respective lateral fletches 28*d* and 28*c*. This arrangement of the fletches 28 results in a highly stable flight path for the arrow 50**.

Considering now FIG. 8, there is shown superimposed upon the riser 52 a line L which represents the drawplane for the bow string (not shown) associated with the riser 52. A sight window 60 is dimensioned to provide somewhat greater clearance on each side of line L than is found in conventional center shot bows. The larger window 60 allows clearance for the lateral fletch **28*c* as well as avoids interference with the wider wing section 56. Of course, the arrow 50 must be used with an undersupporting arrow rest 44 which is supported on a shelf 62 forming the bottom of sight window 60**.

Arrow 20 is adapted to be used in combination with a conventional center shot bow in a manner as shown for example in FIG. 2. When the arrow 20 is released from the bow, the wing section 32 modifies the air stream created by the forwardly moving arrow 20 in a manner to provide aerodynamic lift at a point just forwardly of the center of gravity G. This lift tends to hold the leading end of the shaft 22 slightly elevated and extends the flight of the arrow 20 such that a level flight path is maintained at distances well beyond 25 yards. During flight, the fletches 28 serve to preclude rotation of the shaft 22 about its elongate axis, therby providing a highly stable flight for the arrow 20. Of course, the operation and use of arrow 50 is substantially the same as that for arrow 20 with the exception that wing section 56 provides greater lift than the wing section 32.

Because of the substantially level flight of the arrow 20, the resultant force upon target impact is significantly increased. Manifestly, the arrow 20, by virtue of its level flight path, will enter a given target at a shallower angle than a conventional arrow directed at the same target from an equal distance; hence, the resultant impact force of arrow 20 on the target will be greater than that of the conventional arrow, all other parameters being equal. In actual practice, it has been found that arrow 20 exhibits approximately a 30% increase in the resultant force over prior art arrows.

It is noted that with either of the arrows 30 or 50, the resultant aerodynamic lift may be increased by slightly angling the wing section 32 or 56 with respect to the longitudinal axis of the shaft 22. It is believed that angles of attack ranging from 0° to 8° would prove satisfactory.

From the foregoing, it can be seen that the present invention offers a significant improvement over archery equipment heretofore available. The arrows 20, 50 exhibit level flight paths for distances far exceeding the level flight path range of conventional arrows. Moreover, the arrow 20 may be used in combination with a conventional bow without requiring significant modification. In this latter regard, the archer need only provide an undersupporting arrow rest similar to rest 44 in order to convert his existing bow for acceptance of arrows 20.

What I claim is:

1. An improved arrow for use in combination with an archery bow, said arrow comprising:

an elongate, generally cylindrical shaft having a point at one end, a string-receiving nock at the opposite end, and a center of gravity intermediate said ends;

at least one fletch extending radially outwardly from said shaft adjacent said opposite end; and airfoil structure mounted on said shaft intermediate said ends in alignment with the normal direction of flight of said arrow for improving the flight range and accuracy thereof as well as increasing the resultant force on impact, said structure intersecting a transverse right sectional plane passing through said shaft at said center of gravity.

2. The arrow of claim 1; said airfoil structure including a wing section and a generally upright strut securing said wing section in offset relation to said shaft.

3. The arrow of claim 2, said wing section being of cambered configuration.

4. The arrow of claim 3, the diameter of said shaft being at least as great as the width of said wing section.

5. The arrow of claim 2, said member disposing said wing section at an attack angle in the range of 0° to 8° relative to the longitudinal axis of said shaft.

6. The arrow of claim 1, there being a pair of said fletches on said shaft, spaced circumferentially from one another within the range from 40° to 170°.

* * * * *